US009376993B2

(12) United States Patent
Lehmann et al.

(10) Patent No.: US 9,376,993 B2
(45) Date of Patent: Jun. 28, 2016

(54) LEVER DEVICE AND A FUEL INJECTION VALVE

(71) Applicants: Stefan Lehmann, Lappersdorf (DE); Hellmut Freudenberg, Grossberg (DE); Stefan Kohn, Hohenberg (DE); Robert Kuchler, Regen (DE); Manuel Hannich, Regensburg (DE); Roland Feigl, Regensburg (DE); Wolfgang Wechler, Regensburg (DE); Matthias Wicke, Wernberg-Koblitz (DE)

(72) Inventors: Stefan Lehmann, Lappersdorf (DE); Hellmut Freudenberg, Grossberg (DE); Stefan Kohn, Hohenberg (DE); Robert Kuchler, Regen (DE); Manuel Hannich, Regensburg (DE); Roland Feigl, Regensburg (DE); Wolfgang Wechler, Regensburg (DE); Matthias Wicke, Wernberg-Koblitz (DE)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 115 days.

(21) Appl. No.: 14/369,837
(22) PCT Filed: Dec. 19, 2012
(86) PCT No.: PCT/EP2012/076158

§ 371 (c)(1),
(2) Date: Jun. 30, 2014

(87) PCT Pub. No.: WO2013/098155

PCT Pub. Date: Jul. 4, 2013

(65) Prior Publication Data

US 2015/0021418 A1 Jan. 22, 2015

(30) Foreign Application Priority Data

Dec. 30, 2011 (DE) ..... 10 2011 090 200

(51) Int. Cl.
*F02M 63/00* (2006.01)
*F02M 51/06* (2006.01)

(52) U.S. Cl.
CPC ..... *F02M 51/0603* (2013.01); *F02M 63/0033* (2013.01); *F02M 2200/702* (2013.01)

(58) Field of Classification Search
CPC ..... F02M 61/10; F02M 51/0603; F02M 63/0026; F02M 2200/702
USPC ..... 239/533–533.12, 585.2–585.51; 251/129.2, 129.06
See application file for complete search history.

(56) References Cited

U.S. PATENT DOCUMENTS 3,945,261 A * 3/1976 Wright ..... F16D 65/22 188/331
4,863,141 A * 9/1989 Brunner ..... F16K 31/10 251/129.15

(Continued)

FOREIGN PATENT DOCUMENTS

DE 19757659 C1 6/1999 ..... F02M 51/06
DE 19857615 C1 7/2000 ..... F02M 51/06

(Continued)

OTHER PUBLICATIONS

International Search Report and Written Opinion, Application No. PCT/EP2012/076158, 14 pages, Mar. 22, 2013.

(Continued)

*Primary Examiner* — Arthur O Hall
*Assistant Examiner* — Viet Le
(74) *Attorney, Agent, or Firm* — Slayden Grubert Beard PLLC

(57) ABSTRACT

A lever device for a fuel injection valve includes a housing with a housing recess, at least one lever element arranged in the housing recess and having a coupling section coupled to a section of the housing, a drive element arranged in the housing recess and coupled to the at least one lever element to act upon the at least one lever element in the direction of a force-action axis, and an output element arranged in the housing recess and coupled to the at least one lever element such that the output element may be moved in the force-action axis direction by the at least one lever element. The coupling section of the lever element has at least one recess that defines at least two coupling section contact surfaces spaced apart from one another and resting against the housing section.

16 Claims, 3 Drawing Sheets

(56) References Cited

U.S. PATENT DOCUMENTS

| | | | | |
|---|---|---|---|---|
| 5,121,730 | A * | 6/1992 | Ausman | F02M 57/025 123/381 |
| 6,186,474 | B1 * | 2/2001 | Fitzner | F02M 51/0603 251/129.2 |
| 6,595,436 | B2 * | 7/2003 | Kirzhner | F02M 51/0603 239/102.2 |
| 6,607,178 | B1 * | 8/2003 | Lixl | F02M 47/027 239/102.2 |
| 6,705,587 | B1 * | 3/2004 | Frank | F02M 47/027 137/315.03 |
| 6,776,390 | B1 * | 8/2004 | Boecking | F02M 47/027 251/129.06 |
| 6,787,973 | B2 * | 9/2004 | Frank | F02M 51/0603 123/470 |
| 7,225,790 | B2 * | 6/2007 | Bartunek | F02M 51/0603 123/294 |
| 7,404,539 | B2 * | 7/2008 | Kronberger | F02M 63/0026 251/129.06 |
| 2003/0160202 | A1 * | 8/2003 | Boecking | F02M 47/027 251/229 |
| 2009/0200406 | A1 * | 8/2009 | Kronberger | F02M 51/0603 239/585.5 |
| 2012/0031378 | A1 * | 2/2012 | Brandt | F02D 41/2096 123/490 |
| 2013/0037622 | A1 * | 2/2013 | Kim | F02M 43/04 239/5 |
| 2013/0153675 | A1 * | 6/2013 | Kronberger | F02M 61/168 239/1 |
| 2014/0346244 | A1 * | 11/2014 | Russe | F02D 41/2096 239/4 |
| 2015/0021418 | A1 * | 1/2015 | Lehmann | F02M 51/0603 239/584 |
| 2015/0028135 | A1 * | 1/2015 | Lehmann | F02M 63/0026 239/584 |

FOREIGN PATENT DOCUMENTS

| | | | | |
|---|---|---|---|---|
| DE | 10002720 | A1 | 3/2001 | F02M 47/02 |
| DE | 10220498 | A1 | 11/2002 | F02M 51/06 |
| DE | 10304240 | A1 | 10/2004 | F02M 51/06 |
| DE | 10326707 | B3 | 1/2005 | B05B 1/08 |
| DE | 102005020366 | A1 | 11/2006 | F02M 51/00 |
| DE | 102005024707 | A1 | 12/2006 | F02M 51/06 |
| DE | 102006017034 | A1 | 10/2007 | F02M 51/06 |
| DE | 102006031567 | A1 | 1/2008 | F02M 51/06 |
| WO | 99/17014 | A1 | 4/1999 | F02M 47/02 |
| WO | 02/057622 | A1 | 7/2002 | F02M 47/02 |
| WO | 2004/076848 | A1 | 9/2004 | F02M 47/02 |
| WO | 2007/116007 | A1 | 10/2007 | F02M 51/06 |
| WO | 2013/098155 | A1 | 7/2013 | F02M 51/06 |
| WO | 2013/098161 | A1 | 7/2013 | F02M 51/06 |

OTHER PUBLICATIONS

International Search Report and Written Opinion, Application No. PCT/EP2012/076183, 15 pages, Mar. 22, 2013.

U.S. Non-Final Office Action, U.S. Appl. No. 14/369,812, 13 pages, Feb. 19, 2016.

U.S. Final Office Action, U.S. Appl. No. 14/369,812, 10 pages, May 23, 2016.

* cited by examiner

LEVER DEVICE AND A FUEL INJECTION VALVE

CROSS-REFERENCE TO RELATED APPLICATIONS

This application is a U.S. National Stage Application of International Application No. PCT/EP2012/076158 filed Dec. 19, 2012, which designates the United States of America, and claims priority to DE Application No. 10 2011 090 200.7 filed Dec. 30, 2011, the contents of which are hereby incorporated by reference in their entirety.

TECHNICAL FIELD

The invention concerns a lever device for a fuel injection valve, with a housing, at least one lever element, a drive element and an output element. The invention furthermore concerns a fuel injection valve for an internal combustion engine of a motor vehicle, comprising the lever device and a valve needle which is coupled to the output element or which forms the output element.

BACKGROUND

Fuel injection valves for an internal combustion engine of a motor vehicle can comprise actuators which are in particular formed as piezo-actuators. Such actuators comprise a piezo-ceramic material. Such actuators can change their linear extension depending on an electric field which acts in the piezo-ceramic material. The piezo-electric actuators used as servo components, in particular in fuel injection valves for internal combustion engines in motor vehicles, are arranged in a housing so that they can execute a stroke movement in the axial direction. The actuator can in particular be coupled to a lever device, by means of which the stroke of the actuator can be translated.

SUMMARY

One embodiment provides a lever device for a fuel injection valve with a housing which has a housing recess, at least one lever element which is arranged in the housing recess and has a coupling portion which is coupled to a portion of the housing, a drive element which is arranged in the housing recess and is coupled to the at least one lever element to act on the at least one lever element in the direction of the force-action axis, and an output element arranged in the housing recess which is coupled to the at least one lever element such that the output element can be moved in the direction of the force-action axis by means of the at least one lever element, wherein the coupling portion of the lever element has at least one recess, by means of which at least two contact faces of the coupling portion are formed which are spaced apart from each other and lie on the portion of the housing.

In a further embodiment, the at least two contact faces of the coupling portion are formed as convex curved faces.

Another embodiment provides a fuel injection valve which comprises a lever device disclosed above, and a valve needle which is coupled to the output element or which forms the output element, wherein the drive element and the valve needle are coupled together via the lever device such that the valve needle in a closed position prevents a fluid flow through the fuel injection valve, and otherwise allows a fluid flow through the fuel injection valve.

BRIEF DESCRIPTION OF THE DRAWINGS

Example embodiments of the invention are explained in more detail below with reference to the drawings, in which.

DETAILED DESCRIPTION

Embodiments of the invention provide a lever device for a fuel injection valve which is persistently reliable, and a fuel injection valve which has a long service life.

According to a first aspect, a lever device for a fuel injection valve includes a housing which has a housing recess, at least one lever element which is arranged in the housing recess and has a coupling portion which is coupled to a portion of the housing, a drive element which is arranged in the housing recess and is coupled to the at least one lever element to act on the at least one lever element in the direction of a force-action axis, and an output element arranged in the housing recess which is coupled to the at least one lever element such that the output element can be moved in the direction of the force-action axis by means of the at least one lever element. The coupling portion of the lever element has at least one recess, by means of which at least two contact faces of the coupling portion are formed which are spaced apart from each other and lie on the portion of the housing.

This has the advantage that the lever element can achieve a low stiffness in a region between the contact faces of the coupling portion. As a result, any mechanical irregularities on the at least one lever element and/or on the housing portion can only exert a slight influence on the movement of the lever element, and hence changes in the injection quantities can be kept small or avoided altogether. In this way a persistently reliable operation of the lever device and hence of the fuel injection valve is possible.

In one embodiment, the at least two contact faces of the coupling portion are formed as convex curved faces. This has the advantage that the friction and wear of the lever element can be very low. For example a rolling action of the lever element in relation to the housing portion allows the load on the contact faces to be kept small. Thus the at least one lever element allows a persistently reliable operation of the lever device.

According to a second aspect, a fuel injection valve comprises the lever device and a valve needle. The valve needle is coupled to the output element or forms the output element. The drive element and the valve needle are coupled together via the lever device such that the valve needle in a closed position prevents a fluid flow through the fuel injection valve, and otherwise allows this. Because of the distance between the at least two contact faces of the coupling portion, such a valve can be operated persistently reliably.

Figure 1:
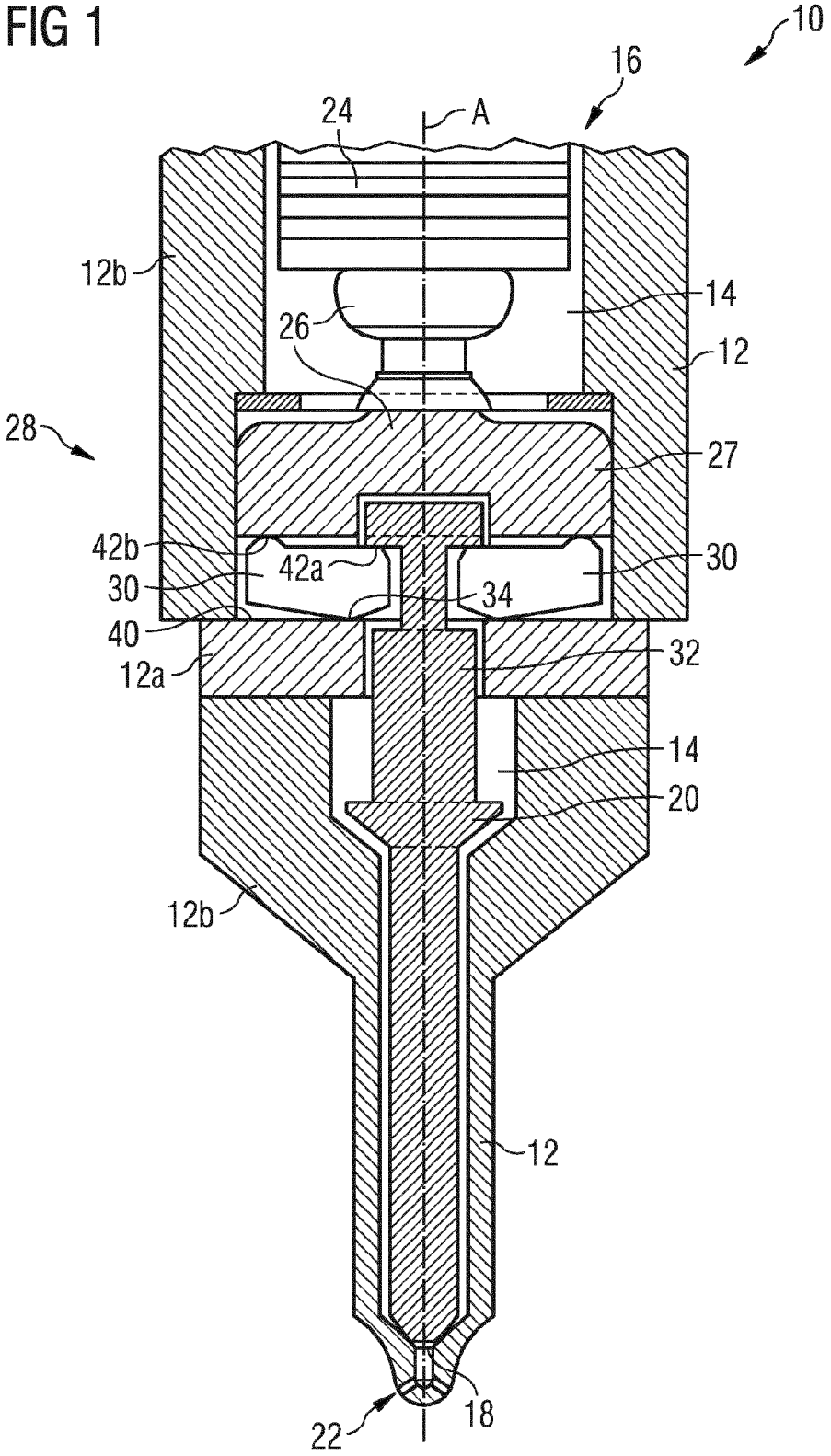
FIG. 1 is a diagrammatic depiction of a fuel injection valve.

FIG. 1 shows a valve, in particular a fuel injection valve 10 for an internal combustion engine in a motor vehicle.

The fuel injection valve 10 has a housing 12. The housing 12 has several portions 12*a*, 12*b*. The housing 12 in particular has a disk-like portion 12*a* which is arranged between two tubular portions 12*b* of the housing 12. The disk-like portion 12*a* and the two tubular portions 12*b* are fixedly coupled together, and together form the housing 12. A housing recess 14 is formed in the housing 12, with a fluid inlet 16 and a fluid outlet 18. The injection valve 10 can be supplied with fuel in the region of the fluid inlet 16 via a connection (not shown), which is coupled hydraulically to the housing recess 14.

A valve needle 20 is arranged axially movably in the housing recess 14 and in a closed position closes an injection nozzle 22 and otherwise allows a fuel flow through the injection nozzle 22.

The injection valve 10 comprises a piezoelectric actuator 24. Instead of the piezoelectric actuator 24, another actuator can also be provided e.g. a magnetostrictive actuator or an electromagnetic actuator.

The fuel injection valve 10 furthermore comprises a drive element 26 coupled to the actuator 24. The drive element 26 preferably has a pin or a rod which respectively transmits the stroke or a drive force of the actuator 24. The actuator 24 and the drive element 26 are coupled together in the axial direction. A stroke of the drive element 26 is dependent on an axial expansion of the piezoelectric actuator 24, which in turn is dependent on a control signal which can be supplied to the piezoelectric actuator 24. The drive element 26 furthermore comprises a preferably bell-shaped component 27.

Furthermore a lever device 28 is arranged in the housing recess 14 of the fuel injection valve 10. The lever device 28 comprises the drive element 26 and a lever element 30 or several lever elements 30. In the embodiment shown, the lever device 28 had two lever elements 30 (see also FIG. 2). The lever elements 30 are coupled to the drive element 26. Furthermore the lever elements 30 are coupled to an output element 32. The output element 32 is arranged in the housing recess 14. The output element 32 is preferably coupled to the valve needle 20. The valve needle 20 can also form the output element 32. The drive element 26, lever element 30 and output element 32 cooperate such that the stroke of the drive element 26 is transmitted to the valve needle 20 and the valve needle 20 is thus moved into its closed position or an open position.

A force-action axis A of a drive force of the drive element 26 passes through the drive element 26 and continues through the output element 32 as a force-action axis of an output force.

In further embodiments, the force-action axis through the drive element 26 is offset to the force-action axis through the output element 32.

Figure 2:
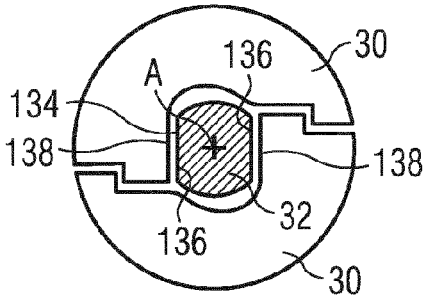
FIGS. 2 and 2*a* show cross-sections through a lever device in various embodiments.

FIG. 2 shows an embodiment of the lever device 28 in a cross-section.

The lever elements 30 each have a coupling region 134. In the embodiment shown in FIG. 2, the output element 32 has two flat wall segments 136. The flat wall segments 136 lie opposite each other in relation to the force-action axis A of the output element 32. Furthermore, the coupling regions 134 of the lever elements 30 each have a flat wall segment 138. The flat wall segments 138 of the lever elements 30 are assigned to the flat wall segments 136 of the output element 32. In each case one of the flat wall segments 138 of the lever element 30 lies opposite a flat wall segment 136 of the output element 32. In this way the flat wall segments 136 of the output element 32 cooperate with the flat wall segments 138 of the lever element 30, and thus allow the lever elements 30 to be coupled to the output element 32 rotationally fixedly in relation to the force-action axis A. As a result, the lever elements 30 can no longer rotate in relation to the valve needle 20. Thus the conditions on injection of the fuel injection valve 10 can be held constant over many injection processes.

Figure 2A:
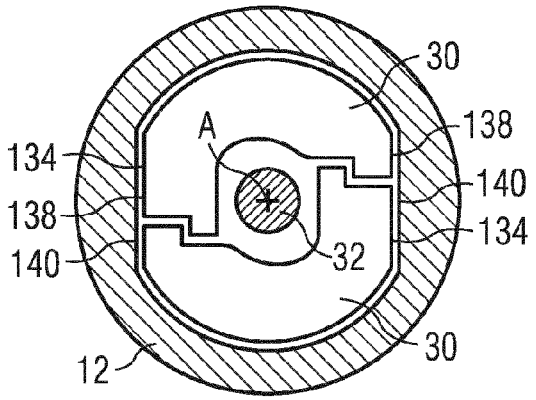
Figure 3:
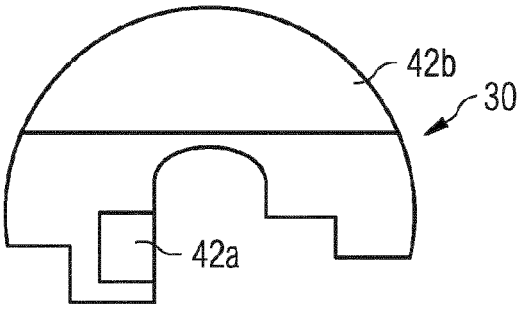
FIG. 3 shows a top view of a lever element of the lever device.
Figure 4:
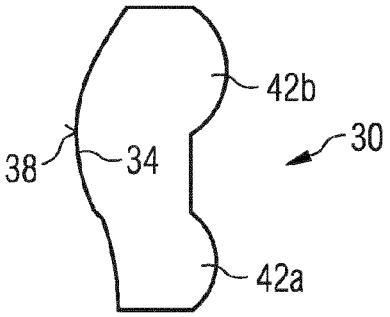
FIG. 4 shows a side view of the lever element.
Figure 5:
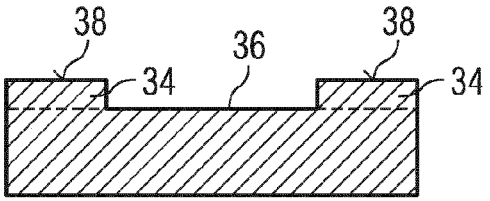
FIG. 5 shows a longitudinal section through the lever element.
Figure 6:
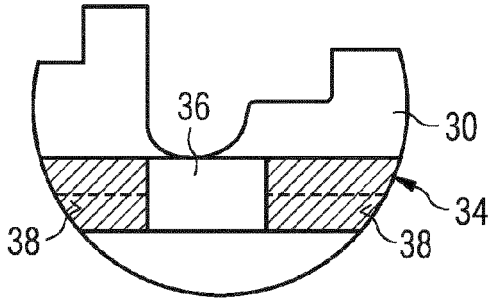
FIG. 6 shows a further view of the lever element.

In the embodiment of the lever device 28 shown in FIG. 2*a*, the coupling regions 134 of the lever elements 30 have flat wall segments 138. The housing recess 14 of the housing 12 has two flat wall segments 140 which lie opposite each other in relation to the force-action axis A. In each case one of the flat wall segments 138 of one of the lever elements 30 cooperates with one of the flat wall segments 140 of the housing recess 14. As a result, the lever element 30 is coupled to the housing 12 rotationally fixedly in relation to the force-action axis A. The rotationally fixed coupling of the lever elements 30 to the housing 12 allows the contact conditions between the lever elements 30 and the housing 12 to be held constant over a long period. Thus the injection behavior of the fuel injection valve 10 can be held constant over a long period.

FIGS. 3 to 6 show an embodiment of the lever element 30 in different views.

The lever element 30 has a coupling portion 34. The coupling portion 34 is coupled to the disk-like portion 12*a* of the housing (see also FIG. 1). The coupling portion 34 has a recess 36. The recess 36 is configured such that two contact faces 38 are formed on the coupling portion 34 which are spaced apart from each other. The two contact faces 38 of the coupling portion 34 lie on a contact face 40 of the disk-like portion 12*a* of the housing 12. The contact face 40 of the disk-like portion 12*a* of the housing 12 has a surface normal which is parallel to the force-action axis A.

In the embodiment of the lever element 30 shown in FIGS. 3 to 6, the two contact faces 38 of the coupling portion 34 are formed as convex curved faces. This allows the lever element 30 to perform a rolling action in relation to the disk-like portion 12*a* of the housing 12.

Figure 7:
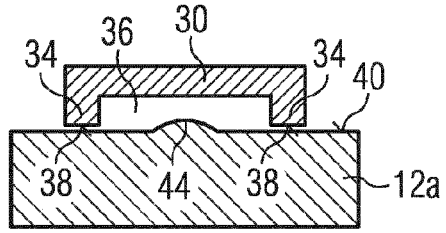
FIG. 7 shows a longitudinal section through the lever element and a portion of a housing of the fuel injection valve.

The function method of the lever element 30 with the recess 36 of the coupling portion 34 will now be explained below with reference to FIGS. 7 and 8:

In FIG. 7, the disk-like portion 12*a* of the housing 12 has a protrusion 44 which lies between the contact faces 38 of the coupling portion 34 in the region of the recess 36 of the coupling portion 34. Because of the configuration of the recess of the coupling portion 34, the lever element 30 can rest against the disk-like portion 12*a* of the housing 12 without influence from the protrusion 44. A movement of the lever element 30 in relation to the disk-like portion 12*a* of the housing 12, over the contact faces 38 of the coupling portion 34 and the contact face 40, can thus take place without disruption from the protrusion 44.

Figure 8:
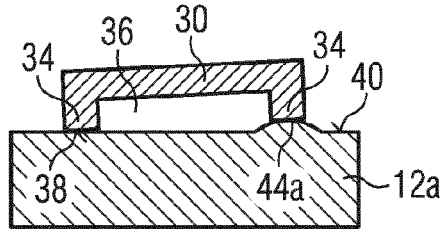
FIG. 8 shows a longitudinal section through the lever element and the housing portion.

In FIG. 8, the disk-like portion 12*a* of the housing 12 has a further protrusion 44*a* which lies in the region of one of the contact faces 38 of the coupling portion 34. Because of the configuration of the recess 36 of the coupling portion 34, the lever element 30 has a low stiffness in the region of the recess 36. As a result, on movement of the lever element 30 in relation to the disk-like portion 12*a* of the housing 12, the lever element can yield in the region of the recess 36. Consequently the further protrusion 44*a* has only a slight influence on the movement of the lever element 30 and hence on the movement of the output element 32.

Figure 9:
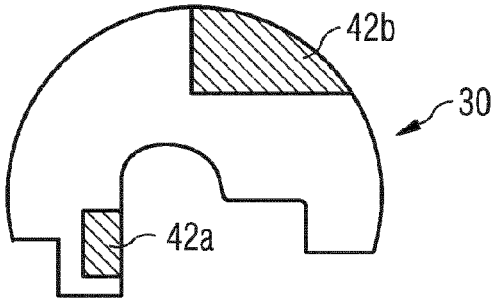
FIG. 9 shows a further top view of the lever element.

The lever element 30 has further coupling portions 42*a*, 42*b* (FIG. 9). One of the further coupling portions 42*a* is coupled to the output element 32. Another of the further coupling portions 42*b* is coupled to the bell-shaped component 27 of the drive element 26 (see FIG. 1). In the embodiment shown in FIG. 9, the further coupling portion 42*a* coupled to the output element 32 is arranged in relation to the further coupling portion 42*b* coupled to the drive element 26 such that as large as possible a distance is created between the further coupling portions 42*a*, 42*b* at the lever element 30. Due to the formation of as large as possible a distance between the further coupling portions 42*a*, 42*b*, the lever element 30 can have a lower stiffness in the region between the two coupling portions 42*a*, 42*b* than in the region of the further coupling portions 42*a*, 42*b*. As a result, on a movement of the lever element 30 in relation to the drive element 26 or output element 32, the lever element 30 can yield in the region between the further coupling portions 42*a*, 42*b*. As a result, mechanical irregularities on the drive element 26 or output element 32 have only a slight influence on the movement of the lever element 30 and consequently on the movement of the output element 32.

As a result of the configuration of the lever elements 30 with the recess 36 of the coupling portion 34, the lever elements 30 can cooperate with the disk-like portion 12*a* of the housing 12 over a plurality of injection processes, without the transmission behavior between the lever elements 30 and disk-like portion 12*a* of the housing 12 changing decisively. Thus stable injection conditions of the fuel injection valve 10 can be maintained over a plurality of injection processes of the fuel injection valve 10. As a result, component tolerances—in particular of the lever element 30 and/or the disk-like portion 12*a* of the housing 12, and due for example to the protrusions 44, 44*a*—have only a very slight or no effect at all on the injection quantities of the fuel injection valve 10.

What is claimed is:

1. A lever device for a fuel injection valve, the lever device comprising:

a housing having a housing recess, at least one lever element, each arranged in the housing recess and having a coupling portion coupled to a portion of the housing, a drive element arranged in the housing recess and coupled to the at least one lever element to act on the at least one lever element along a longitudinal axis, and an output element arranged in the housing recess and coupled to the at least one lever element such that the output element is moveable along the longitudinal axis by the at least one lever element, wherein for each lever element, the coupling portion has a recess that defines at least two contact faces of the coupling portion that are spaced apart from each other and lie on the portion of the housing.

2. The lever device of claim 1, wherein the at least two contact faces of the coupling portion comprise convex curved faces.

3. The lever device of claim 1, wherein the portion of the housing comprises a disk shape.

4. The lever device of claim 1, wherein the portion of the housing comprises at least one protrusion extending toward the at least one lever element in the longitudinal direction.

5. The lever device of claim 4, wherein each protrusion is arranged between the at least two contact faces of the coupling portion of a respective lever element.

6. The lever device of claim 4, wherein each protrusion contacts one of the contact faces of the coupling portion of a respective lever element.

7. The lever device of claim 1, wherein the drive element comprises a bell-shaped element configured to act on the at least one lever element.

8. The lever device of claim 1, wherein:

the at least one drive element comprises first and second drive elements arranged around a perimeter of the output element, the output element defines first and second opposing flat wall segments, the first flat wall segment of the output element facing a corresponding flat wall section of the first drive element and the second flat wall segment of the output element facing a corresponding flat wall section of the second drive element.

9. A fuel injection valve, comprising:

a lever device comprising:

a housing having a housing recess, at least one lever element, each arranged in the housing recess and having a coupling portion coupled to a portion of the housing, a drive element arranged in the housing recess and coupled to the at least one lever element to act on the at least one lever element along a longitudinal axis, and an output element arranged in the housing recess and coupled to the at least one lever element such that the output element is moveable along the longitudinal axis by the at least one lever element, wherein for each lever element, the coupling portion has a recess that defines at least two contact faces of the coupling portion that are spaced apart from each other and lie on the portion of the housing, and a valve needle coupled to or defining the output element, wherein the drive element and the valve needle are coupled together via the lever device such that a closed position of the valve needle prevents a fluid flow through the fuel injection valve and other positions of the valve needle allow a fluid flow through the fuel injection valve.

10. The fuel injection valve of claim 9, wherein the at least two contact faces of the coupling portion comprise convex curved faces.

11. The fuel injection valve of claim 9, wherein the portion of the housing comprises a disk shape.

12. The fuel injection valve of claim 9, wherein the portion of the housing comprises at least one protrusion extending toward the at least one lever element in the longitudinal direction.

13. The fuel injection valve of claim 12, wherein each protrusion is arranged between the at least two contact faces of the coupling portion of a respective lever element.

14. The fuel injection valve of claim 12, wherein each protrusion contacts one of the contact faces of the coupling portion of a respective lever element.

15. The fuel injection valve of claim 9, wherein the drive element comprises a bell-shaped element configured to act on the at least one lever element.

16. The fuel injection valve of claim 9, wherein:

the at least one drive element comprises first and second drive elements arranged around a perimeter of the output element, the output element defines first and second opposing flat wall segments, the first flat wall segment of the output element facing a corresponding flat wall section of the first drive element and the second flat wall segment of the output element facing a corresponding flat wall section of the second drive element.

* * * * *